US006199229B1

(12) United States Patent
Wong

(10) Patent No.: US 6,199,229 B1
(45) Date of Patent: Mar. 13, 2001

(54) COLLAPSIBLE AND FOLDABLE STRUCTURE

(75) Inventor: Kenneth Man Kin Wong, Kowloon (HK)

(73) Assignee: Bo Kon Enterprises, Ltd. (HK)

( * ) Notice: Subject to any disclaimer, the term of this patent is extended or adjusted under 35 U.S.C. 154(b) by 0 days.

(21) Appl. No.: 09/182,864

(22) Filed: Oct. 30, 1998

(51) Int. Cl.[7] ..... A47D 13/06
(52) U.S. Cl. ..... 5/417; 5/418; 5/655; 135/125
(58) Field of Search ..... 5/99.1, 417, 418, 5/655; 135/124, 125, 126, 128

(56) References Cited

U.S. PATENT DOCUMENTS 4,858,634 * 8/1989 McLeese ..... 135/126
5,056,172 * 10/1991 Kaiser et al. ..... 5/417
5,059,463 * 10/1991 Peters ..... 5/418 X
5,249,592 * 10/1993 Springer et al. ..... 135/126
5,337,772 * 8/1994 Habchi ..... 135/125
5,385,165 * 1/1995 Hazinski et al. ..... 135/126

FOREIGN PATENT DOCUMENTS

0487642B1 9/1998 (EP) .

* cited by examiner

*Primary Examiner*—Michael F. Trettel
(74) *Attorney, Agent, or Firm*—Burns, Doane, Swecker & Mathis, L.L.P.

(57) ABSTRACT

This invention provides a collapsible and foldable structure suitable for use by infants as a play area for both indoor and, in particular, outdoor use. The invention incorporates the use of flexible loops of material which may be deformed into a plurality of concentrated loops when in the collapsed state for easy transportation and storage. A sheet of material may be attached on which the infant may lie and includes a raised member extending over the sheet to which a further cover may be attached and/or used for hanging items for the child's amusement or entertainment.

9 Claims, 4 Drawing Sheets

COLLAPSIBLE AND FOLDABLE STRUCTURE

FIELD OF THE INVENTION

This invention relates to a collapsible and foldable structure and, in particular, although not necessarily solely, such a structure for use in providing an activity area for young children.

DESCRIPTION OF THE PRIOR ART

A number of items exists in the marketplace for providing an activity area for young children, particularly babies. The intention for such structures is to provide an area for a baby to play which can be transported to an outdoor location.

Typically, existing items may provide some form of ground sheet for placement on the ground and a support frame to support an overhead cover or to hang toys or other items for the child's amusement over the ground sheet. The difficulty with existing items is that they generally require assembly and disassembly to package for transportation. Not only is this a time consuming task but also leads to the risk of pieces going missing or being left behind.

OBJECT OF THE INVENTION

It is an object of the present invention to provide a collapsible and foldable structure which does not require disassembly and provides an opportunity for placement of covers, toys or other articles over a young child. It is at least an object of the present invention to provide a collapsible and foldable structure which provides the public with a useful choice.

SUMMARY OF THE INVENTION

Accordingly, in a first aspect, the invention may broadly be said to consist in a collapsible and foldable structure including:

at least a first loop of flexible material;

a second loop of flexible material connected adjacent to said first loop about a portion of the circumferences of said loops; and at least a first sheet of material attached to a portion of the free non-interconnected portions of said first and second loops.

Accordingly, in a second aspect, the invention may broadly be said to consist in a foldable and collapsible structure including:

at least a first loop of flexible material;

biasing means connected at discreet points about said loop to bias said loop into a non-planar configuration; and at least a first sheet of material attached to a portion of said loop.

Further aspects of this invention will be apparent to those skill in the art to which the invention relates on reading the following description.

BRIEF DESCRIPTION OF THE DRAWINGS

Preferred embodiments of the invention will now be described with reference to the following drawings in which.

DETAILED DESCRIPTION OF PREFERRED EMBODIMENTS

A first embodiment of the invention is shown in FIGS. 1 through 5. The apparatus comprises a collapsible and foldable apparatus 1 suitable to provide some cover for an infant or young child then outdoors or otherwise provide a play and activity area for the child.

The embodiment as shown in these figures includes a first loop 2 of flexible material. A second loop 3 is also provided of which a portion is preferably of similar curvature as at least a portion of the first loop 2.

Figure 1:
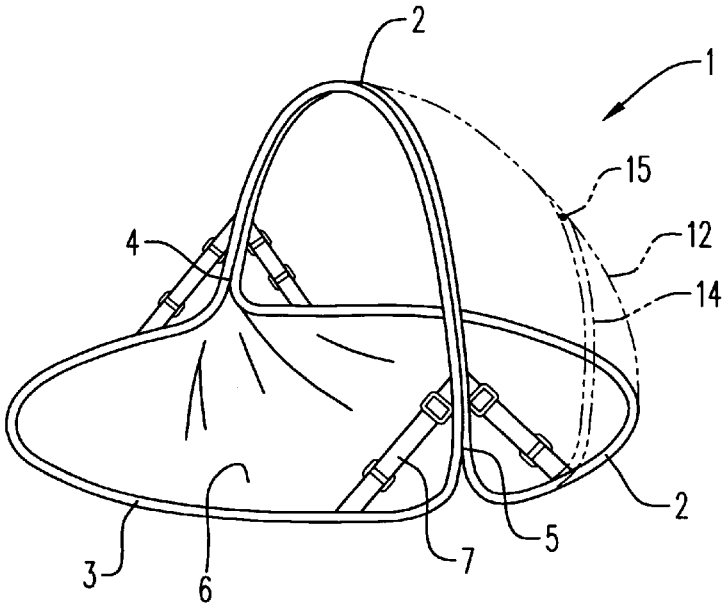
FIG. 1 shows a perspective view of a first embodiment of the apparatus in an expanded state.

As shown in FIG. 1, the first and second loops 2 and 3 are attached adjacent one another or interconnected over a portion of their respective circumferences. Preferably, the portions connected are of similar curvature. As shown in FIG. 1, the loops 2 and 3 are interconnected over a portion of slightly less than one half of their circumferences being interconnected approximately from points 4 to 5 around their circumferences. It should be noted that the length of interconnection about the respective circumferences can be determined to provide a suitable overall structure. When expanded as shown in FIG. 1, it is intended to provide a reasonable area encompassed by the free non-interconnected ends of the loops 2 and 3. However, if the loops are only interconnected over a small portion of their circumference, the resulting structure may lack sufficient height or not provide a balance overall appearance to the apparatus when expanded.

Although the loops do not have to be of similar circumference overall, this is preferred to simplify the folding of the loops as is explained subsequently.

Again referring to FIG. 1, the apparatus 1 can be seen to include a sheet of material 6 which is attached to at least portions of the free ends of the loops 2 and 3. The term "free ends" is used in the specification to refer to those portions of the loops 2 and 3 which are not connected adjacent one another.

The apparatus as shown in FIG. 1 is assumed to be residing on a surface which is a floor or the ground outside. When positioned on a surface, the weight of the apparatus 1 causes the free ends of the loops 2 and 3 to splay and provide a generally planar perimeter to which the flexible sheet 6 may be attached.

Biasing means 7 are also included on this preferred embodiment of the invention. The biasing means are provided to bias the loops 2 and 3 into the expanded condition shown in FIG. 1. The biasing means are connected to the loops at discreet points about their circumference with one end of a biasing means 7 connected to a loop at a point where the alternate loop lies adjacent in the configuration shown in FIG. 1 and the other end of the biasing means may be attached at a point on the circumference of a loop which forms part of the splayed free end portion of the loop. The biasing means 7 provided in FIG. 1 are provided in the form of adjustable straps. By adjusting the length of the strap, the loops 2 and 3 can be deformed into their configuration shown in FIG. 1.

Such biasing means are not required if the weight of the structure is sufficient to overcome the elasticity of the loops 2 and 3 so as to allow them to form the configuration shown in FIG. 1. However, the straps or other biasing means 7 do provide a greater stability to the structure and to the interconnected portion 8 of the loops 2 and 3.

In the form shown, the biasing means are releasable. This is only a preference and fixed straps or similar biasing means can be used. Further, it is preferred that two such biasing means are provided on opposed sides of the loops however one or more may be utilized.

Alternative biasing means such as elastic material or other items to bias the loops 2 and 3 into the configuration shown are also possible. Rather than being adjustable as shown in this preferred embodiment, the straps could simply be releasably connected at one end if it is desired to have the biasing means releasable.

Figure 2:
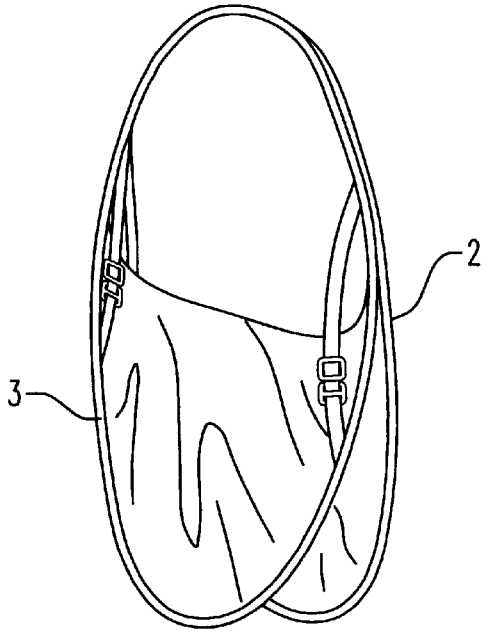
FIGS. 2–5 show perspective views of the apparatus of FIG. 1 in progressively collapsed and folded states.

As shown in FIG. 2, a release of the biasing means being an expansion of the straps 7 in this embodiment and lifting of the apparatus from a surface will allow the loops 2 and 3 to form substantially planar loops. The loops 2 and 3 are shown as being generally circular or oval. There is no particular preference in circular or oval loops.

Figure 3:
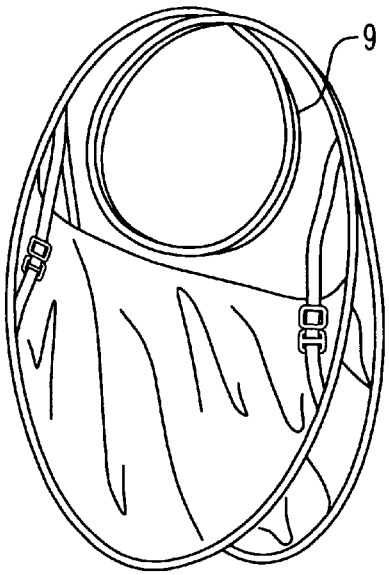
Figure 4:
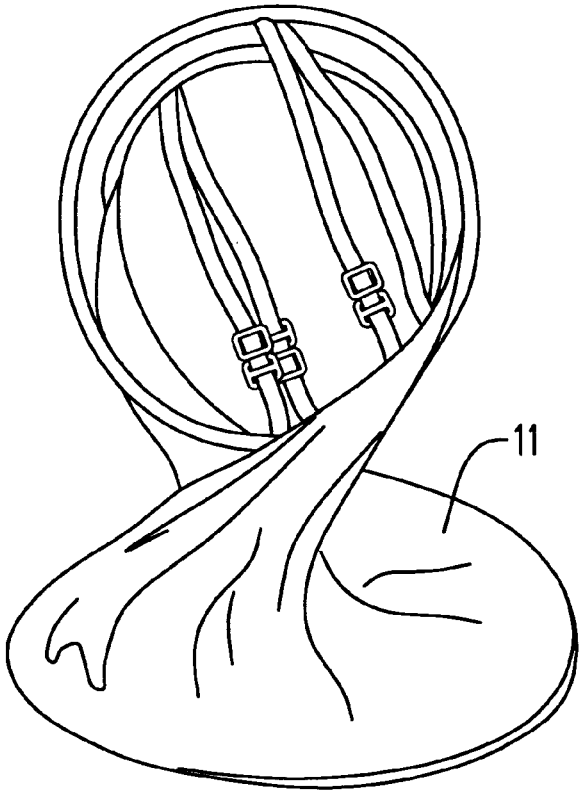
Figure 5:
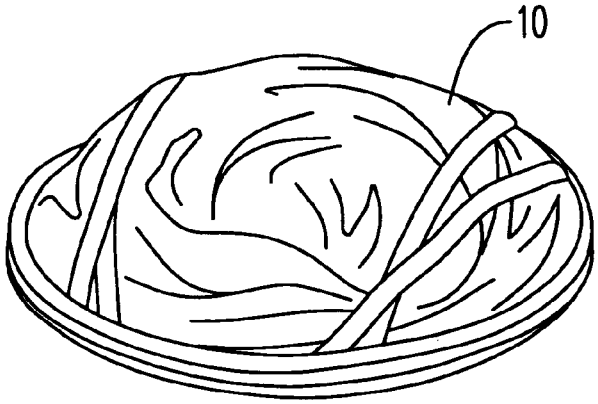

FIGS. 3 to 5 show a sequence of stages by which the apparatus can be folded into a convenient collapsed state for transportation and storage. Generally, it is the intention of the apparatus that the flexible loops 2 and 3 be sufficiently flexible to be deformed into loops having a third of the circumstance of the overall loop. An example of the finished circumference of the article is shown in FIG. 3 where a first portion of the circumferences are formed into a first loop 9.

The sequence to achieve the final collapsed and folded state as shown in FIG. 5 is already known in published literature although generally is described with reference to be folding and twisting of a single loop of material. An example of his is U.S. Pat. No. 5,722,446 in which the sequence to achieve the collapsed state is described. An intermediate position is shown in FIG. 4 wherein the apparatus assumes the state 11 in which the loops are being twisted to allow more circumference portions to be overlaid on other portions of the loops. Basically, the folding can comprise forming a first loop and then twisting the remainder into a "figure eight" configuration. The top half of the "figure eight" may then be folded over to allow all three loops formed from a single loop of material to lie one upon the other.

In an alternative construction, an additional sheet of material 12 may be provided joined to both the interconnected and free ends of a loop such as loop 2 to provide general cover over a portion of the activity or play area defined by the sheet 6. This additional sheet 12 can cover a portion of the hemisphere bounded by the overall apparatus 1. Additional loops of flexible material may be provided such as a loop 14 to help space the additional sheet of material 12 from hanging loosely into the area in which the child will be lying. The further loop 14 may be an attached item as with the additional sheet 12 or permanently attached as part of the apparatus. If attached to an appropriate position on the sheet 12, the loop 14 will be encouraged to assume an elevated position as shown in FIG. 1 from the adjacent loop 2 to which it may be attached at distal ends. A fixing at point 15 on the sheet of material or series of or continuous connection can be provided. Again, the loop 14 should also be made of a flexible material to allow it to be twisted and folded along with loops 2 and 3 to the position 10 as shown in FIG. 5.

If it is desired to provide a fully enclosed structure, an additional sheet of material can be provided from the interconnected loop portions 8 which may be attachable to the free end of the loop 3.

The loops 2 and 3 may be made from a number of flexible materials. Examples of suitable materials are rattan, fibre glass, carbon fibre, graphite, spring, steel, plastics or other such materials. The materials selected should be deformable into a curvature to match obtaining a loop of one-third of the circumference of the original loop. This should be performed within the elastic constraints of the material.

The sheet of material 6 and other cover sheets may be from a suitable synthetic or natural material which can be easily folded during collapsing of the overall apparatus. A simple nylon or polyethylene sheet may suffice.

In use, the apparatus may start off in the collapsed state as shown in FIG. 5. Although this may be restrained by a band or similar item to stop it expanding, an alternative is to use the straps or other biasing means 7 to wrap about the perimeter of the collapsed structure to try and retain it in position. Minimal force is required to retain the loops in the concentric position shown in FIG. 5.

Upon release, the structure will expand under the elastic nature of the materials forming loops 2 and 3 into the position shown in FIG. 1. The straps or other biasing means 7 can be adjusted if required to either stabilize the structure or change the configuration of the structure slightly.

The upper structure 8 which forms above the activity area formed by the sheet 6 can be used to hang rattles, toys and other items for the child's amusement. The structure can be placed on a surface and a child laid on the sheet of material 6 with or without a further cover 12 to provide some shading. The connected portion 8 of the loops forms an overhead frame above the sheet 6.

In a further embodiment, an alternative configuration is shown in the apparatus in FIGS. 6 through 9.

In this embodiment, a single loop of material 20 is provided. The loop 20 can be made from the same materials as the loops 2 and 3 of the previous embodiment. It should be noted that, in this embodiment, the loop of material is provided in a substantially rectangular shape with only the corners rounded to accommodate the curvature capable of the flexible material forming the loop 20.

A sheet of material 21 is fixed around a portion 22 of the circumference of the loop 20. It can be shown in this embodiment that the sheet 21 is attached around approximately one-half of the circumference of the loop 20 although this could be more or less as desired. The sheet 21 may be continuously attached or attached at discreet intervals.

In this embodiment in which only a single loop is provided, there is no second loop to balance against to provide immediate bias and turn the portion 23 which is not attached to the sheet 21 in an upward direction. Instead, biasing means 24 are required to achieve the configuration shown in FIG. 6. Again this biasing means is provided in the preferred form by adjustable straps fixed at discreet points to the loop of material 20 on opposed sides of the points 25 and 26 about which the loop is curved to its out of plane condition. Fixed straps may also be used.

Figure 6:
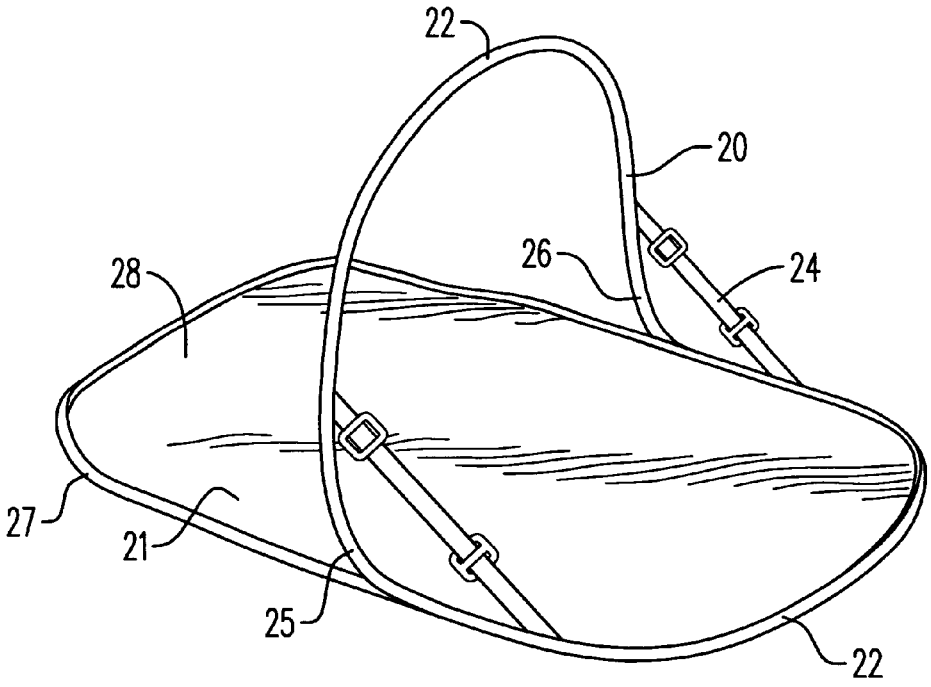
FIG. 6 shows a perspective view of a second embodiment of the apparatus.

The sheet of material 21 may be provided with some beading or heavier material or even a perimeter frame made of flexible material so as to bias the free end 28 of the sheet of material 21 into the form shown in FIG. 6. This may assist the sheet 21 to form a substantially planar sheet and be less liable to fold over should it be caught by the wind outside or otherwise become folded underneath or over an infant. The beading 27 may be made from the same material as the loop 20.

Figure 7:
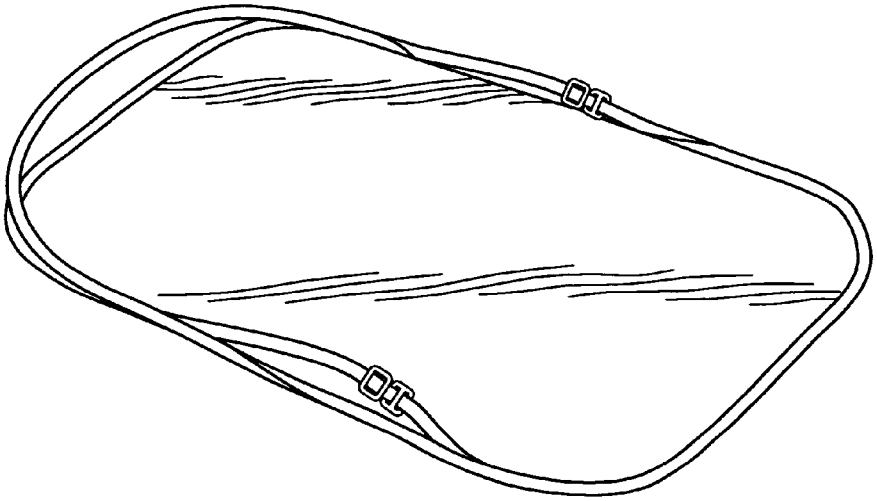
FIGS. 7–9 show perspective views of the apparatus of FIG. 6 in progressively more collapsed and folded states.
Figure 8:
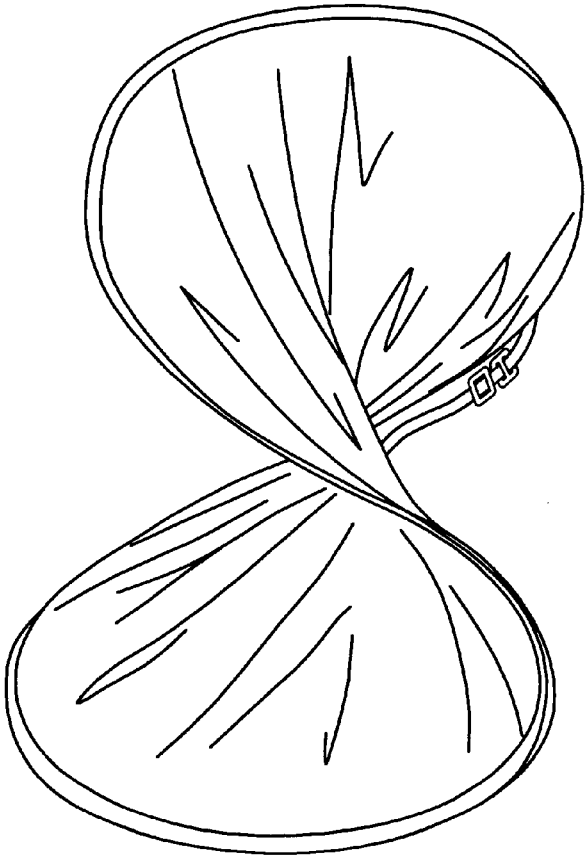
Figure 9:
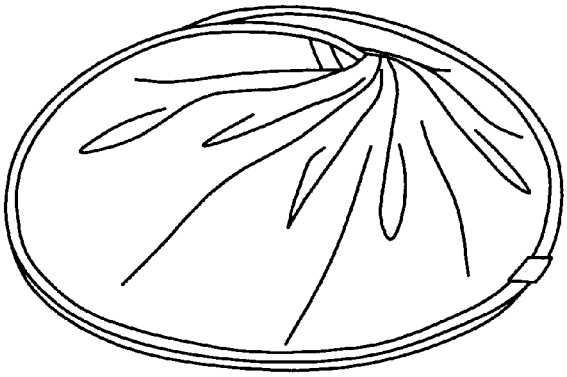

Upon release of the biasing means 24, the loop 20 and the sheet 21 may lie adjacent substantially in plane with one another as shown in FIG. 7. They may both be then deformed as shown in FIG. 8 to achieve a configuration shown in FIG. 9. Again, the configuration shown in FIG. 9 may comprise the loops being deformed into two loops each being half the circumference of the original or, more preferable, three loops having a circumference of a third of the original expanded loop. The manipulation of the loops is the same as the previous embodiment to achieve the collapsed state for easy transportation and storage.

If the biasing means is fixed and not releasable, they may simply be folded up with the apparatus as it is coiled into the two or three loops for storage.

Also in accordance with the previous embodiment, additional sheets of material may be placed over or connected to the portion 23 of the loop 20 to provide some shade or canopy over the ground sheet 21.

Thus it can be seen that the invention provides an apparatus which can be collapsed and folded into an easy unit for transportation. Furthermore, upon release, the structure will form the expanded configuration of its own accord without any complex assembly or disassembly. As all the essential components of the apparatus can be permanently attached as a unitary item, there is little risk of parts being lost as may occur with other apparatus.

Although generally described in terms of an activity area for children, particularly infants, the apparatus may have other uses if desired.

Although the invention has been described in relation to specific preferred embodiments, it will be understood that it is capable of further modification and is intended to cover any variations, uses or adaptions of the invention following the principles of the invention and including such departures as come within the knowledge of those skilled in the art to which the invention relates. Specific integers are deemed to incorporate known equivalents where appropriate and all such equivalents, variations or adaptions may be considered included with the description of the preferred embodiments being a no-sense limiting to the invention, the scope of which is defined in the appended claims.

What is claimed is:

1. A collapsible and foldable structure including:

at least a first loop of flexible material;

a second loop of flexible material connected adjacent to said first loop about a portion of the circumferences of said loops; and at least a first sheet of material attached to a portion of the free non-interconnected portions of said first and second loops;

wherein said first and second loops of flexible material are deformable to a non-planar configuration when said structure is in an expanded state such that said connected portion of the circumferences of said loops provides an apex and said free non-interconnected portions form opposed ends of a base of said erected structure.

2. A collapsible and foldable structure as claimed in claim 1 wherein said loops of flexible material are made from material capable of forming a loop having a circumference of one-third of that of the overall loop.

3. A flexible or foldable structure as claimed in claim 2 wherein said loops of flexible material are made from flexible rattan, fibre glass, carbon fibre, graphite, spring steel or plastic materials.

4. A collapsible and foldable structure as claimed in claim 1 wherein, in an expanded state, said structure provides said first sheet of material in a substantially planar position supported at its ends of said first and second loops and connected portions of said first and second loops provide a frame over and above said first sheet of material.

5. A collapsible and foldable structure as claimed in claim 4 wherein biasing means are provided to bias, retain or support said connected portions of said loops to form said overhead frame.

6. A foldable and collapsible structure as claimed in claim 5 wherein said biasing means comprise a releasable or extendible portion of material connected between discrete points about said loops.

7. A foldable and collapsible structure as claimed in claim 1 wherein said first and second loops of flexible material are connected along approximately one-half of their circumferences, and said sheet of material is attached to substantially all of the non-interconnected portions of said first and second loops.

8. A foldable and collapsible structure including:

at least a first loop of flexible material;

biasing means in the form of releasable or extendible portions of material connected at discrete points about said loop to bias said loop into a non-planar configuration when said structure is in an expanded state; and at least a first sheet of material attached to a portion of said loop.

9. A foldable and collapsible structure as claimed in claim 8 wherein said biasing means comprise adjustable straps.

* * * * *